US010041435B2

(12) United States Patent
Wakeman

(10) Patent No.: US 10,041,435 B2
(45) Date of Patent: Aug. 7, 2018

(54) DIRECT INJECTION FUEL SYSTEM WITH CONTROLLED ACCUMULATOR ENERGY STORAGE AND DELIVERY

(71) Applicant: Russell J Wakeman, Canton, MI (US)

(72) Inventor: Russell J Wakeman, Canton, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 14/571,909

(22) Filed: Dec. 16, 2014

(65) Prior Publication Data

US 2016/0169146 A1 Jun. 16, 2016

(51) Int. Cl.

| | |
|---|---|
| ***F02B 3/00*** | (2006.01) |
| ***F02D 41/38*** | (2006.01) |
| ***F02M 63/02*** | (2006.01) |
| ***F02M 63/00*** | (2006.01) |
| ***F02M 55/04*** | (2006.01) |
| *F02M 37/00* | (2006.01) |
| *F02M 55/02* | (2006.01) |

(52) U.S. Cl.

CPC ..... *F02D 41/3845* (2013.01); *F02M 55/04* (2013.01); *F02M 63/0007* (2013.01); *F02M 63/023* (2013.01); *F02M 63/0265* (2013.01); *F02D 2200/0616* (2013.01); *F02D 2250/04* (2013.01); *F02M 37/0041* (2013.01); *F02M 55/025* (2013.01); *F02M 2200/315* (2013.01); *F02M 2200/40* (2013.01)

(58) Field of Classification Search

CPC ..... F02D 41/3845; F02D 41/3836; F02M 2200/40

USPC ..... 123/294, 446, 447, 456; 701/103

See application file for complete search history.

(56) References Cited

U.S. PATENT DOCUMENTS

| | | | | |
|---|---|---|---|---|
| 3,967,598 | A * | 7/1976 | Rachel | F02D 41/3082 123/179.17 |
| 5,020,978 | A | 6/1991 | Nashif | |
| 5,440,641 | A | 8/1995 | Kuusama | |
| 5,524,057 | A | 6/1996 | Akiho et al. | |
| 5,701,869 | A * | 12/1997 | Richardson | F02D 41/3082 123/447 |
| 5,748,749 | A | 5/1998 | Miller et al. | |
| 6,401,691 | B1 | 6/2002 | Kawano et al. | |
| 6,439,266 | B1 | 8/2002 | Xu et al. | |
| 7,536,018 | B2 | 5/2009 | Onishi et al. | |
| 7,753,032 | B2 | 7/2010 | Iihoshi et al. | |
| 8,393,881 | B2 | 3/2013 | Usui et al. | |

(Continued)

*Primary Examiner* — Marguerite McMahon
*Assistant Examiner* — James Kim
(74) *Attorney, Agent, or Firm* — Ralph E. Smith

(57) ABSTRACT

A direct injection (DI) fuel supply system includes an accumulator valve coupled to a high pressure fuel line at a position between an accumulator and a fuel rail. A controller of the DI fuel supply system is configured to control the accumulator valve to maintain the pressurized fuel housed in the fuel rail at a desired pressure and to control the accumulator valve proximate a fuel injection event by a fuel injector such that the accumulator supplies the fuel rail with approximately the portion of the pressurized fuel injected by the fuel injector during the fuel injection event. This positioning of the accumulator valve between the DI positive displacement fuel pump and the fuel rail together with active control thereof also insulates the fuel rail and the fuel injector from fuel pressure pulsations generated by the DI positive displacement fuel pump.

16 Claims, 2 Drawing Sheets

(56) References Cited

U.S. PATENT DOCUMENTS

| | | | | |
|---|---|---|---|---|
| 8,978,623 | B2 * | 3/2015 | Sommars | F02M 43/04 123/456 |
| 2003/0192508 | A1 | 10/2003 | Kishimoto | |
| 2004/0055574 | A1 * | 3/2004 | Namekawa | F02M 45/00 123/447 |
| 2006/0219220 | A1 * | 10/2006 | Klyza | F02D 41/3809 123/447 |
| 2007/0144492 | A1 * | 6/2007 | Sugiyama | F02D 41/2416 123/480 |
| 2008/0103676 | A1 * | 5/2008 | Ancimer | F02D 19/10 701/103 |
| 2009/0164094 | A1 * | 6/2009 | Geveci | F02D 41/0087 701/103 |
| 2010/0212639 | A1 * | 8/2010 | Nakane | F02M 37/0041 123/511 |
| 2010/0229831 | A1 * | 9/2010 | Hernier | B60W 10/02 123/447 |
| 2012/0279473 | A1 * | 11/2012 | Besancon | F02M 55/02 123/447 |
| 2013/0160741 | A1 * | 6/2013 | Sommars | F02M 43/04 123/456 |
| 2013/0304353 | A1 * | 11/2013 | Viereck | F02D 41/12 701/102 |
| 2015/0176516 | A1 * | 6/2015 | Wakeman | F02D 41/3836 123/294 |
| 2015/0369189 | A1 * | 12/2015 | Teets | F02M 37/0041 123/447 |

* cited by examiner

DIRECT INJECTION FUEL SYSTEM WITH CONTROLLED ACCUMULATOR ENERGY STORAGE AND DELIVERY

FIELD

The present application relates generally to a direct injection (DI) fuel system and, more particularly, to a DI fuel system for a vehicle having controlled accumulator energy storage and delivery.

BACKGROUND

A typical fuel supply system for a port fuel injected internal combustion engine includes an electric fuel pump that conveys fuel being stored in a fuel tank through a fuel supply line to a fuel injector on the engine. As the engine operates, the fuel pump is activated to provide a continuous supply of fuel to the engine. However, an engine's fuel consumption varies greatly with its required output. In order to ensure that the engine is always provided with adequate fuel, the electric fuel pump is typically designed to provide fuel to the engine at the rate required for maximum engine output. More fuel is required during times of higher engine demand and less fuel during times of lesser engine demand, or during idling. Such low pressure fuel systems have incorporated passive accumulators to accumulate excess fuel supplied by the electric fuel pump during times of non-peak engine output.

While these accumulators in port fuel injection systems work for their intended purpose, they are passive accumulators associated with low pressure fuel systems. Such accumulators are not in fluid communication with the fuel injectors and are not associated downstream of a positive displacement pump but upstream of an accumulator control valve on the high pressure side of a direct injection fuel system. As a result, these conventional accumulator arrangements are not effective for directly and accurately supplying pressurized fuel to the injectors of a direct injection system. Further, such conventional accumulator arrangements could be exposed to fuel pressure pulsations generated by the high pressure fuel pump, which could further decrease accuracy of the supplied fuel to the fuel injectors.

SUMMARY

In accordance with an aspect of the invention, a direct injection (DI) fuel supply system for an engine of a vehicle is presented. In one exemplary implementation, the DI fuel supply system includes a fuel rail in fluid communication with a high pressure fuel line and configured to house pressurized fuel; a fuel injector configured to inject at least a portion of the pressurized fuel housed in the fuel rail into the engine; a DI positive displacement fuel pump driven by a crankshaft of the engine, the DI positive displacement fuel pump in fluid communication with and configured to supply the pressurized fuel to the high pressure fuel line; an accumulator fluidly coupled to the high pressure fuel line at a position between the fuel rail and the fuel pump, the accumulator configured to house the pressurized fuel; an accumulator valve positioned in the high pressure fuel line at a location between the accumulator and the fuel rail, the accumulator valve configured to regulate the flow of the pressurized fuel from both the DI fuel pump and the accumulator to the fuel rail; and a controller configured to control the accumulator valve to maintain the pressurized fuel housed in the fuel rail at a desired pressure.

In accordance with an aspect of the invention, a method of operating a DI fuel supply system of a vehicle is presented, the DI fuel supply system having a high pressure fuel line fluidly coupled to a fuel rail in fluid communication with a fuel injector. The method includes: determining, at a controller of the DI fuel supply system, an estimated amount of a pressurized fuel from the fuel rail to be injected by the fuel injector during a fuel injection event, the DI fuel supply system including an accumulator valve in the high pressure fuel line positioned upstream of the fuel rail and downstream of an accumulator fluidly coupled to the high pressure fuel line; controlling the accumulator valve during the fuel injection event such that the accumulator supplies the fuel rail with approximately the estimated portion of the pressurized fuel injected during the fuel injection event; and controlling recharging of the accumulator by: commanding the accumulator valve closed, and commanding a DI positive displacement fuel pump of the DI fuel supply system to supply the pressurized fuel to the accumulator.

In some implementations, the controller is further configured to close the accumulator valve to insulate the fuel rail from fuel pressure pulsations generated by the DI positive displacement fuel pump. In some implementations, the DI fuel supply system includes a piezo device configured to generate cancellation fuel pressure pulsations in the DI fuel supply system, and the controller is configured to control the piezo device to generate the cancellation fuel pressure pulsations to cancel at least a portion of the fuel pressure pulsations generated by the DI positive displacement fuel pump.

In some implementations, the controller is further configured to: estimate the portion of the pressurized fuel that the fuel injector will inject during a fuel injection event; and control the accumulator valve proximate the fuel injection event such that the accumulator supplies the fuel rail with approximately the estimated portion of the pressurized fuel injected during the fuel injection event. In some implementations, the controller is configured to control the accumulator valve based further on at least one of: (i) a static flow rate of the accumulator valve, (ii) a timing of the fuel injection event, (iii) a desired pressure of the pressurized fuel in the fuel rail, and (iv) a pressure differential between a pressure of the pressurized fuel in the accumulator and a pressure of the pressurized fuel in the fuel rail.

In some implementations, the DI fuel supply system includes a fuel rail pressure sensor configured to measure a pressure of the pressurized fuel in the fuel rail, wherein the controller is configured to utilize measurements from the fuel rail pressure sensor in controlling the accumulator valve. In some implementations, the DI fuel supply system includes an accumulator pressure sensor configured to measure a pressure of the pressurized fuel in the accumulator, wherein the controller is configured to utilize measurements from the accumulator pressure sensor in controlling the accumulator valve.

In some implementations, the controller is further configured to control charging of the accumulator by the DI positive displacement fuel pump based on the measurements from the accumulator pressure sensor. In some implementations, the controller is configured to enable charging of the accumulator by the DI fuel pump when the measured accumulator pressure is less than a low pressure threshold, and wherein the controller is configured to disable charging of the accumulator by the DI fuel pump when the measured accumulator pressure is greater than a high pressure threshold that is greater than the low pressure threshold.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the essence of the present disclosure are intended to be within the scope of the present disclosure.

DESCRIPTION

As previously mentioned, there remains a need for a direct injection (DI) fuel supply system including an accumulator arrangement that (i) directly and accurately supplies pressurized fuel to the fuel rail/injectors and (ii) insulates the fuel rail/injectors from fuel pressure pulsations generated by a high pressure fuel pump. Other accumulator arrangements, such as arranging the accumulator between the high pressure fuel pump and the fuel rail/injectors, suffer from potentially inaccurate fuel injection due to inaccurate fuel rail pressure control arising from the direct connection between the high pressure accumulator and the fuel rail. In other words, the fuel rail/injectors are susceptible to the high pressure in the accumulator, which could be much higher than a calibrated pressure for the fuel rail/injectors. Moreover, such accumulator arrangements are susceptible to fuel pressure pulsations generated by the high pressure DI fuel pump. Pulsation canceling techniques could be utilized to compensate for these fuel pressure pulsations, but this increases complexity and/or cost of the DI fuel supply system.

Accordingly, an improved DI fuel supply system with controlled accumulator energy storage and delivery is presented. In one exemplary implementation, the DI fuel supply system includes an accumulator valve coupled to a high pressure fuel line at a point between an accumulator and a fuel rail, where the accumulator valve is configured to regulate a flow of pressurized fuel from both the DI fuel pump and the accumulator to the fuel rail. The DI fuel supply system also includes a controller configured to control the accumulator valve to maintain the pressurized fuel housed in the fuel rail at a desired pressure. In one exemplary implementation, the controller controls the accumulator valve during fuel injection by the fuel injectors such that the DI fuel pump provides pressurized fuel to the high pressure fuel line while the fuel rail and the accumulator are providing the pressurized fuel to the fuel injectors. This positioning of the accumulator valve between the DI fuel pump and the fuel rail together with active control thereof also insulates the fuel rail from fuel pressure pulsations generated by the DI fuel pump. In one exemplary implementation, piezo devices (e.g., a stack of piezoelectric actuators) could be implemented and controlled to generate cancellation pulsations in the DI fuel supply system to compensate for any remaining fuel pressure pulsations, such as high frequency fuel pressure pulsations.

Figure 1:
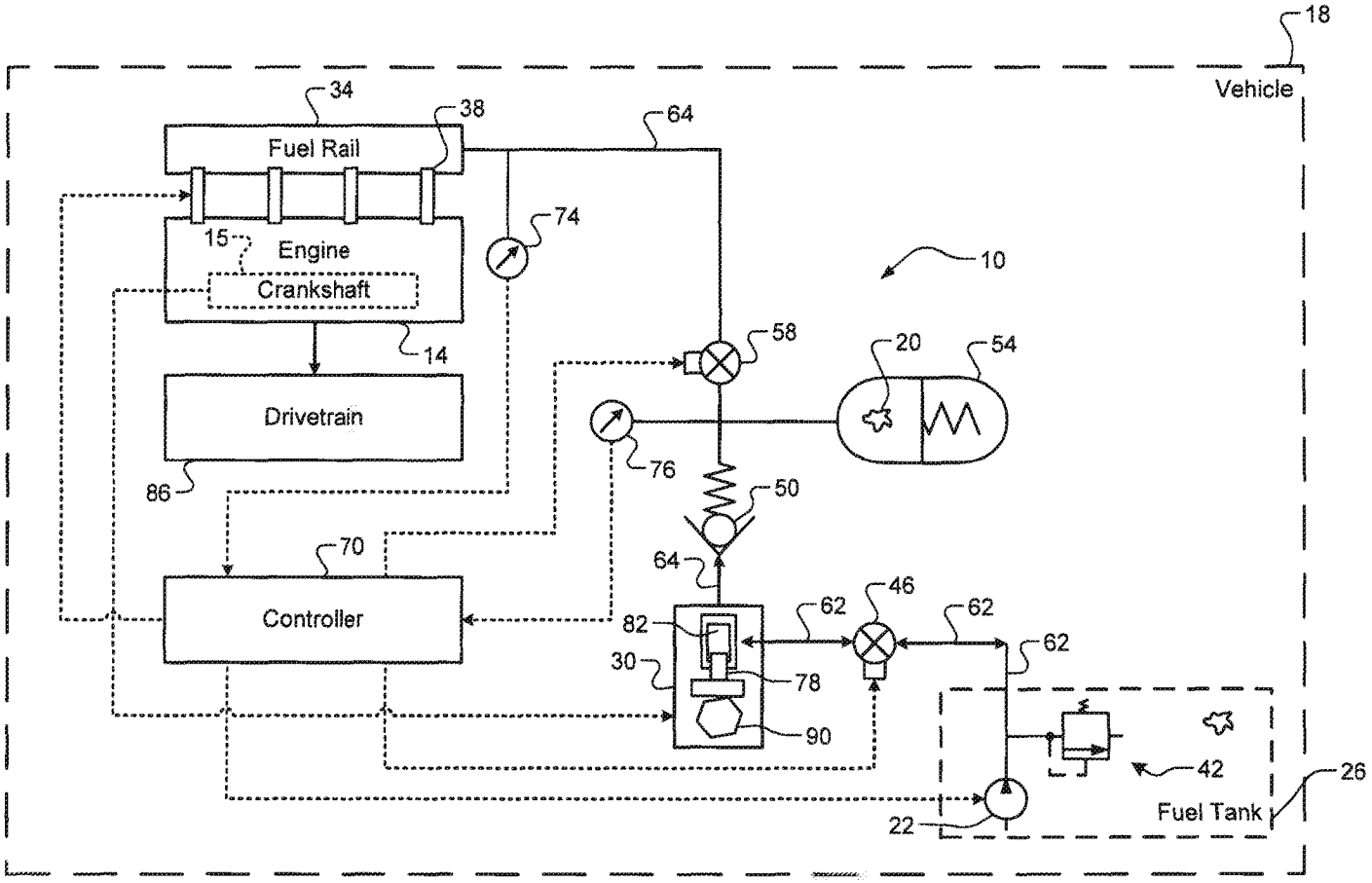
FIG. 1 is a schematic view of an example direct injection (DI) fuel supply system having controlled accumulator energy storage and delivery according to the principles of the present disclosure.

Turning now to the drawings, FIG. 1 illustrates an example DI fuel supply system 10 having controlled accumulator energy storage and delivery. As shown, the DI fuel supply system 10 is associated with an engine 14 and a vehicle 18. As will be discussed in greater detail below, the DI fuel supply system 10 advantageously utilizes a mechanically driven (e.g., by engine 14) positive displacement pump to harvest pressurized fuel 20 for storage in a high pressure accumulator during a vehicle/engine coast or deceleration event, thereby not incurring any immediate energy losses (as the energy driving the positive displacement pump is produced by the inertia of the vehicle 18 and not by running the engine 14). Conventional low pressure fuel systems, such as port fuel injection systems with electric fuel pumps, cannot provide such energy storage without incurring energy losses (e.g., continued power to electric fuel pump).

As will also be discussed in greater detail below, the DI fuel supply system 10 of the present disclosure includes the accumulator on the high pressure side or section of the system downstream of the positive displacement pump and in fluid communication with the fuel rail (and thus also the fuel injectors). This arrangement provides the ability to directly supply pressurized fuel to the fuel injectors from the accumulator without requiring fuel from the fuel pump, which is advantageous on a restart of a DI engine system. Further, by including a control valve between the fuel rail/injectors and both the DI fuel pump and the accumulator in the above-discussed exemplary implementation, the pressure of the pressurized fuel in the fuel rail (as well as the accumulator) is controllable while still insulating the fuel rail from fuel pressure pulsations generated by the fuel pump. These and other exemplary features of DI fuel supply system 10 will be discussed in greater detail below.

With continuing reference to FIG. 1, an example architecture of the DI fuel system 10 includes lift fuel pump 22 disposed in or proximate to a fuel tank 26 for supplying fuel at a low or lower pressure to an engine-driven positive displacement mechanical or DI fuel pump 30. In one implementation, lift fuel pump 22 is an electric fuel supply pump. As will be discussed in greater detail below, the positive displacement pump 30 provides high pressure fuel to a fuel rail 34 and fuel injectors 38 associated therewith at the significantly higher pressures required for a direct injection system. For example only, gasoline direct injection fuel systems typically operate at an injection pressure much higher than conventional port fuel injected (PFI) systems (that use only the low pressure electric fuel pump 22 or equivalent), often at a level approximately 50 times the pressure of the conventional PFI system (e.g., 200 bar vs. 4 bar).

The lift fuel pump 22 and the positive displacement pump 30 are in fluid communication with a pump relief valve 42, a pump spill valve 46, a pump outlet check valve 50, a high pressure accumulator 54 and accumulator valve 58, as well as the fuel rail 34 and fuel injectors 38. Examples of the accumulator include a metal bellows type accumulator or a spring type accumulator, although any other suitable high pressure accumulator could be utilized. In the exemplary implementation illustrated in FIG. 1, the pump spill valve 46 and accumulator valve 58 are solenoid valves. In one exemplary implementation, the accumulator valve 58 could be a digital valve generally controlled to open or closed positions, or a linear valve, which could provide potential NVH improvement over digital valves as well as greater operational control. In one exemplary implementation, the fluid communication within the DI fuel system 10 is provided by fuel supply lines 62, 64 and 66. In the exemplary implementation shown in FIG. 1, the system includes only two pumps—the electric lift fuel pump 22 and the engine driven positive displacement pump 30.

A controller 70, such as an engine or powertrain controller, monitors and/or controls the lift fuel pump 22, pump spill solenoid valve 46, accumulator solenoid valve 58, a fuel rail pressure sensor 74, and an accumulator pressure sensor 76, as schematically shown in FIG. 1. In DI fuel supply system 10, the spill valve 46 in conjunction with the controller 70 regulates the pressure in the accumulator 54 by controlling the inlet and the start of pumping of the positive displacement pump 30. The controller 70 also regulates the pressure in the fuel rail 34 by controlling the accumulator valve 58. More particularly, the controller 70 regulates the flow of pressurized fuel from the accumulator 54 and/or the positive displacement pump 30 by controlling the accumulator valve 58. In doing so, the controller 70 is able to maintain the pressure in both the fuel rail 34 and the accumulator 54 at desired fuel pressure levels or within desired fuel pressure ranges (e.g., by monitoring feedback from the fuel rail pressure sensor 74 and the accumulator pressure sensor 76, respectively).

In the exemplary implementation of the positive displacement pump 30 as illustrated in FIG. 1, the spill valve 46 controls the inlet and start of pumping during the cycle of a mechanical plunger 78 of the positive displacement pump 30. With the spill valve 46 open during a charging stroke of the pump 30, the full swept volume of the plunger 78 is inducted into the pump 30. During the pumping stroke of the plunger 78, the spill valve 46 remains open, which allows the plunger 78 to force fuel back to the fuel tank 26 until the required amount of fuel remains in the plunger chamber 82. Closing the spill valve 46 at this point allows the rising plunger 78 to raise the pressure of the remaining fuel and deliver the fuel through the check valve 50 to the fuel rail 34 and thus the injectors 38. In this manner, pumping work is reduced to the minimum necessary to deliver the desired quantity of fuel at the desired pressure to the fuel rail 34.

Positioning the high pressure accumulator 54 downstream of the mechanical positive displacement pump 30 and check valve 50 (i.e., in the high pressure section of the DI fuel supply system 10) as shown in FIG. 1 provides for the ability to store fuel pump energy as pressurized fuel under conditions where the inertia of the vehicle 18 drives the engine 14 through the drivetrain 86 and thus the engine driven positive displacement pump 30 directly. Thus, under these conditions (e.g., vehicle/engine coast and/or deceleration), the energy driving the pump 30 is not necessarily produced by running the engine 14, which is not typically being fueled during deceleration or downhill coasting, and is thus directly harvested from the inertial movement of the drivetrain 86 with no immediate losses. Further, positioning the accumulator 54 in fluid communication with fuel rail 34 provides the ability for the accumulator 54 to selectively supply pressurized fuel directly to the fuel rail 34 and rapidly change the pressure in fuel rail 34 in a more rapid manner than by a positive displacement fuel pump.

By positioning the accumulator valve 58 between the fuel rail 34 and both the accumulator 54 and the positive displacement fuel pump 30, however, the pressure in the fuel rail 34 is able to be directly and accurately controlled. In other words, the accumulator 54 and the positive displacement fuel pump 30 are not always in direct fluid communication with the fuel rail 34 due to the presence of the accumulator valve 58. If the accumulator 54 and the positive displacement fuel pump 30 were in direct fluid connection or communication with the fuel rail 34, the pressures in both the fuel rail 34 and the accumulator 54 could widely vary during transient events, such as fuel injections or fuel injection events by the fuel injectors 38. Moreover, without the accumulator valve 58 being positioned downstream of both the accumulator 54 and the positive displacement fuel pump 30, fuel pressure pulsations generated by the positive displacement pump 30 could propagate to the fuel rail 34 and affect fuel rail pressure and, thus, subsequent fuel injection events, such as during charging of the accumulator 54. Note that the optional placement of fuel rail pressure sensor 74 shown in FIG. 1 as another component could be arranged between the accumulator 54 and the fuel rail 34.

Positioning the accumulator 54 in the high pressure section of the DI fuel supply system 10 (e.g., connected with high pressure fuel line 64 downstream of pump 30) provides the ability to harvest and/or save significantly more energy than in a conventional PFI fuel system. For example, since pumping work is the product of flow rate and pressure, the high pressure section of the DI fuel supply system 10 requires approximately 50 times the amount of work to pressurize the same flow rate as compared to a conventional PFI fuel system (e.g., 200 bar vs. 4 bar). As a result, there is significantly more energy to be harvested/stored in the high pressure section of the DI fuel supply system 10 as compared to the PFI fuel system.

It should be appreciated that while the accumulator 54 is shown in FIG. 1 positioned between the accumulator valve 58 and positive displacement pump 30, the accumulator 54 could be positioned in other locations in the high pressure section of DI fuel supply system 10 so long as the accumulator valve 58 is in direct fluid communication with the fuel rail 34 and is configured to regulate the flow of pressurized fuel from the accumulator 54 and the positive displacement fuel pump 30. In operation, the accumulator 54 in conjunction with the accumulator valve 58 is controlled by controller 70 to selectively allow pressurized fuel to flow into accumulator 54 and selectively release the pressurized fuel directly to the fuel rail 34 according to various control algorithms and/or strategies, examples of which are discussed below. In this regard, controller 70 monitors operation of engine 14, vehicle 18 and various other sensors, features and/or components in communication therewith, such as those shown in the exemplary system schematically illustrated in FIG. 1.

In one implementation, when the vehicle 18 is operating under a deceleration event, the accumulator 54 is pumped up to a maximum allowable pressure or the highest attainable pressure during the duration of the deceleration event from negative torque applied to the engine 14 by vehicle 18 inertia. In this implementation, the controller 70 commands the lift pump 22 to be on while commanding the spill valve 46 to be open during the induction stroke of the pump 30 and closed during the full pumping stroke of pump 30 to maximize flow into the accumulator 54. In this regard, the controller 70 also commands accumulator valve 58 to be open during deceleration such that pressurized fuel from pump 30 is able to flow into accumulator 54 until the pressure in accumulator 54 reaches a predetermined threshold. The controller 70 could also command the positive displacement fuel pump 30 in conjunction with commanding the accumulator valve 58 open in order to maintain a relatively constant fuel pressure in the accumulator 54 while also refilling the fuel rail 34.

In one implementation, the controller 70 receives a pressure signal from the fuel rail pressure sensor 74 and compares this signal to the predetermined threshold. If the pressure signal received by controller 70 is below the predetermined threshold, the accumulator valve 58 remains open during the deceleration event and is commanded to close by controller 70 upon completion of the deceleration event or if the pressure signal exceeds the predetermined threshold. If the accumulator valve 58 is commanded to close by controller 70 before completion of the deceleration event, the lift pump 22 is commanded by controller 70 to turn off and the spill valve 46 is commanded to open in order to avoid over pressuring the fuel rail 34.

At engine 14 shutdown (e.g., where a key-off signal or equivalent is received by controller 70), in one exemplary implementation, the lift pump 22 is commanded by controller 70 to an off state and the accumulator valve 58, to the extent open, is commanded to close to trap and/or store pressurized fuel for a subsequent cold or warm engine 14 start/restart. In one exemplary implementation, the engine 14 is controlled to stop at a particular crank angle in an effort to facilitate a rapid restart. In this scenario, the DI fuel supply system 10 is controlled to deadhead positive displacement pump 30 (e.g., fuel injectors 38 in an off state, spill valve 46 closed, and accumulator valve 58 commanded to close at a calibrated time) thereby creating high resistance to rotation of pump 30 at a particular crank angle by sharply raising fuel system pressure as the pump plunger 78 rises on the next pump cam lobe 90. In one exemplary implementation, the pump cam lobe 90 is driven directly or indirectly by a crankshaft 15 of the engine 14.

With rapid pressurization of fuel rail 34 available from accumulator 54 on restart, pressure in the fuel rail 34 could optionally be allowed to fall or bleed down at shutdown or initiation of shutdown, thereby reducing a potential for fuel leakage via the fuel injectors 38 during an engine-off period that could potentially contribute to evaporative emissions. In addition, engine 14 coast down energy could be harvested by accumulator 54 during shutdown for the next restart since the positive displacement pump 30 is mechanically driven and will function as the engine 14 coasts down to zero speed on shutdown. Conventional PFI fuel systems and/or other fuel systems with only electric fuel pumps cannot perform this function as such pumps stop functioning upon key-off.

Accumulator valve 58 is then controlled, in one exemplary implementation, to provide pressurized fuel harvested from vehicle 18 deceleration energy or shutdown energy (as discussed above) to the fuel rail 34 thereby reducing engine 14 parasitic losses. Pressurized fuel in accumulator 54 could be available during vehicle 18 shutdown (i.e., engine 14 off) without a requirement to crank the engine 14 and/or operate the fuel pump to restart the vehicle 18. This could result in a faster restart because the pressurized fuel from accumulator 54 is available more quickly than can be generated by fuel pumps. Having pressurized fuel from accumulator 54 available upon initiation of a restart provides for more immediate fuel atomization which could result in lower particulate emissions. Further, with placement of accumulator 54 in fluid communication with fuel rail 34 downstream of positive displacement pump 30, fuel pressure to the fuel rail 34 could be raised more quickly during transients than by pump 30 alone.

For a vehicle 18 restart event (e.g., where a key-on signal or equivalent is received by controller 70), use of stored pressurized fuel in accumulator 54 enables faster restarts by utilizing immediate or near immediate pressurized fuel available at injection pressure from accumulator 54. One reason for this, as briefly discussed above, is because a longer period of time is required to build injection pressure at fuel rail 34 from positive displacement pump 30. Further, for vehicle 18 cold starts, use of pressurized fuel from accumulator 54 enables faster and cleaner cold starts because the immediate or near immediate fuel at injection pressure in cold ambient temperatures improves fuel atomization and thereby reduces particulate emissions. Without accumulator 54, the positive displacement pump 30 will raise pressure less quickly due at least to slower engine 14 cranking speeds in the cold ambient conditions.

In one implementation when the vehicle 18 is under a restart event and the controller 70 determines that the pressure in accumulator 54 is sufficient to supply pressurized fuel to the injectors 38, the controller 70 commands the lift pump 22 to an on state, the spill valve 46 to open and the accumulator valve 58 to open. The controller 70 is optionally configured to determine the accumulator 54 pressure with the accumulator valve 58 open using the fuel rail pressure sensor 74 signal. Otherwise or in addition thereto, the accumulator pressure can be determined using the accumulator pressure sensor 76. When the accumulator valve 58 is closed, such as just prior to a vehicle 18 restart event, the accumulator 54 pressure could be inferred based on controller 70 storing the fuel rail pressure from fuel rail pressure sensor 74 at the time of the prior closing of accumulator valve 58. Commanding the accumulator valve 58 to open under restart as discussed above rapidly pressurizes the fuel rail 34 in a manner faster than with positive displacement pump 30. In one implementation, initial injections from fuel injectors 38 are solely from pressurized fuel from accumulator 54, which provides faster restarts and combustion assistance for an engine starter associated with engine 14. As pressurized fuel from accumulator 54 is depleted to a point where controller 70 determines pressure in fuel rail 34 is at or near nominal injector pressure via pressure sensor 74 and/or 76, spill valve 46 is commanded to close to restart supply of pressurized fuel from positive displacement pump 30.

In another implementation, pressurized fuel from accumulator 54 is utilized in conjunction with positive displacement pump 30 for initial restart. One exemplary instance for this operation is when stored fuel in accumulator 54 is below nominal injection pressure but above a predetermined threshold (stored in controller 70) such that pressurized fuel from accumulator 54 could still provide a more rapid engine 14 start than with pump 30 alone. During steady state operation of the vehicle 18, pressurized fuel stored in accumulator 54 could be selectively utilized based on operating conditions of the engine 14 and the pressure of the stored fuel relative to nominal injection pressure. For example, when pressure in the accumulator 54 is at or above nominal injection pressure, controller 70 commands the lift pump 22 to an off state, the spill valve 46 to open and the accumulator valve 58 to open.

Because the accumulator valve 58 is often closed, fuel pressure pulsations generated by the positive displacement fuel pump 30 are prevented from propagating to the fuel rail 34. In particular, these fuel pressure pulsations could be generated by the positive displacement fuel pump 30 during charging or filling of the accumulator 54. The controller 70 then controls opening of the accumulator valve 58 based on a specific control strategy. This control strategy uses information about the next delivery of the fuel injectors 38 (i.e., a next fuel injection cycle or event), which is already known by the controller 70 because the controller 70 also controls the fuel injectors 38. Based on this information, the controller 70 calculates a pulse or amount of fuel to be delivered by the accumulator 54 to the fuel rail 34. Inputs to this calculation could include at least one of (i) the amount of fuel the fuel injectors 38 will deliver out of the fuel rail 34 for a fuel injection event, (ii) a static flow rate of the accumulator valve 58, (iii) a timing of the fuel injection, (iv) the desired pressure in the fuel rail 34, and (v) a current pressure differential between the varying accumulator pressure and the relatively constant fuel rail pressure. In one exemplary implementation, this calculation is based on all five of these inputs.

In this manner, the accumulator 54 and the accumulator valve 58 take over pressure regulation of the fuel rail 34 by delivering the same amount of fuel to the fuel rail 34 as the fuel injectors 38 inject into the engine 14, thereby maintaining the desired fuel rail pressure. In one exemplary implementation, if it is desirable to raise the fuel rail pressure, the accumulator valve 58 is controlled by the controller 70 such that the accumulator 54 delivers a larger amount of fuel to the fuel rail 34 than the fuel injectors 38 deliver to the engine 14. Similarly, in one exemplary implementation, if it is desirable to lower the fuel rail pressure, the accumulator valve 58 is controlled by the controller 70 such that the accumulator 54 and the positive displacement fuel pump 30 deliver a smaller amount of fuel to the fuel rail 34 than the fuel injectors 38 deliver to the engine 14, or no fuel at all. As previously discussed, the accumulator pressure sensor 76 is used by the controller 70 to monitor the accumulator pressure. More particularly, the controller 70 is configured to control charging and discharging of the accumulator 54 via the positive displacement fuel pump 30 based on this monitoring. For example only, accumulator pressure could be allowed to drop to a margin above the fuel rail pressure before charging by the positive displacement fuel pump 30 is initiated by the controller 70.

The synchronous delivery of fuel out of the fuel injectors 38 (from the fuel rail 34) and into the accumulator 54 (from the positive displacement fuel pump 30) also has the desirable effect of reducing fuel rail pressure pulsations. This is because the decrease in fuel rail pressure associated with the opening of the fuel injectors 38 in a conventional system is now back-filled with the accumulator's simultaneous delivery of fresh fuel into the fuel rail 34. Since the fuel pressure pulsations are blocked, fuel rail pressure stability may be considerably better than in a conventional system. Moreover, off times for the positive displacement fuel pump 30 are able to be significantly increased utilizing the disclosed configuration and control techniques. In one exemplary implementation, the off times for the positive displacement fuel pump 30 could be up to 95%, depending on operating conditions, as well as decreased fuel rail pressure pulsations.

Figure 2:
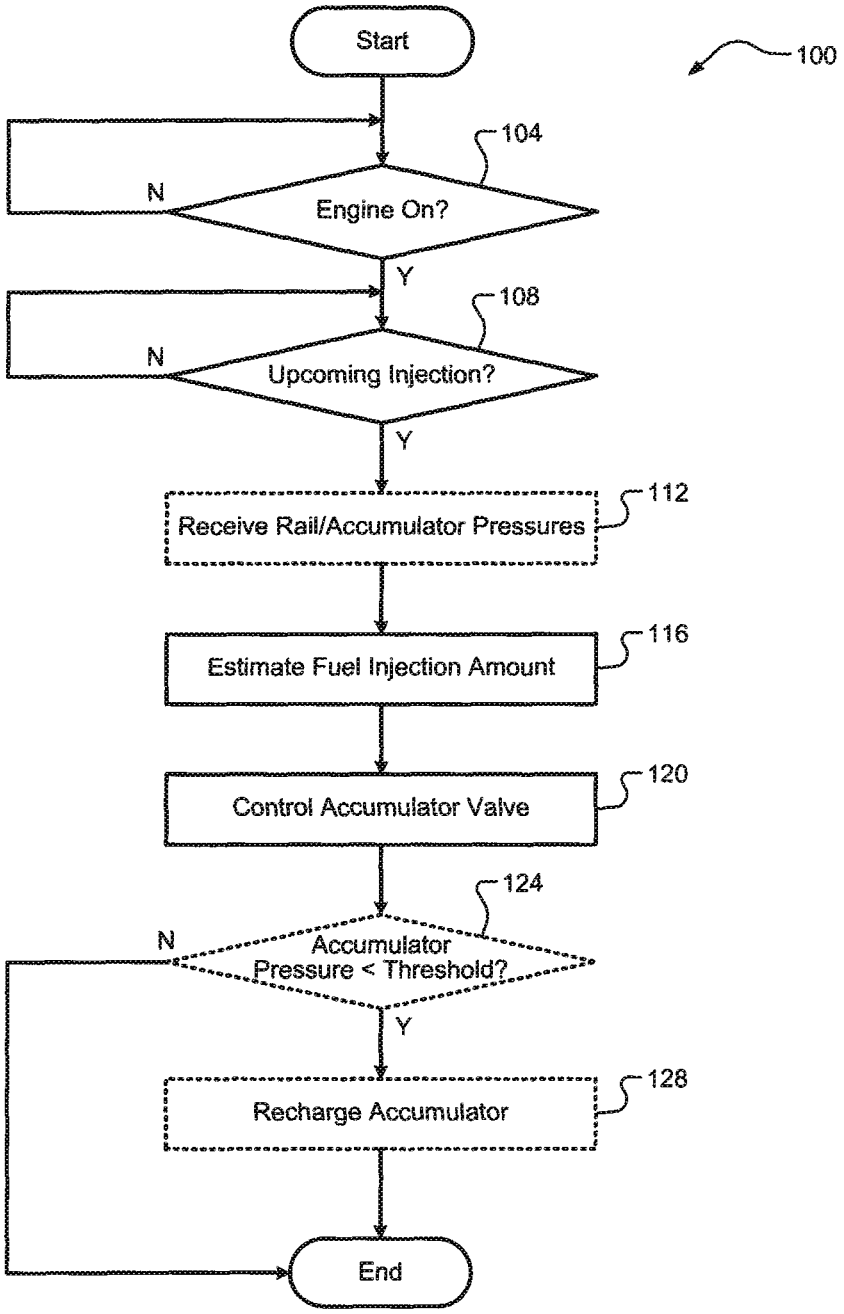
FIG. 2 is a flow diagram of an example method of operating the DI fuel supply system according to the principles of the present disclosure.

Turning now to FIG. 2, an example method 100 for operating the DI fuel supply system 10 is illustrated. At 104, the controller 70 determines whether the engine 14 is on. If true, the method 100 proceeds to 108. If false, the method 100 ends or returns to 104. At 108, the method 100 determines whether a fuel injection event or cycle is upcoming or imminent (e.g., within a predetermined period from occurring). If true, the method 100 proceeds to 112. If false, the method 100 ends or returns to 108. At 112, the controller 70 optionally receives measured fuel rail pressure (e.g., from fuel rail pressure sensor 74) and/or measured accumulator pressure (e.g., from accumulator pressure sensor 76).

At 116 the controller 70 estimates a portion of the pressurized fuel in the fuel rail 34 that will be injected by one or more of the fuel injectors 38 during the upcoming fuel injection. In one exemplary implementation, the controller 70 already has information (e.g., stored in memory) for estimating the portion of the pressurized fuel. Examples of this information include engine speed and engine load. In one exemplary implementation, the controller 70 additionally or alternatively uses the measured fuel rail pressure (e.g., from the fuel rail pressure sensor 74) and/or the measured accumulator pressure (e.g., from the accumulator pressure sensor 76) in estimating the portion of the pressurized fuel to be injected by the fuel injector(s) 38.

At 120, the controller 70 controls the accumulator valve 58 during the fuel injection event based on the estimated portion of the pressurized fuel such that the accumulator 54 and/or the positive displacement fuel pump 30 supply the fuel rail 34 with the approximately the same portion of pressurized fuel that is injected by the fuel injector(s) 38. In one exemplary implementation, the controller 70 controls the accumulator valve 54 based further on at least one of (i) a static flow rate of the accumulator valve 58, (ii) a timing of the fuel injection, (iii) a desired pressure of the pressurized fuel in the fuel rail 34, and (iv) a pressure differential between a pressure of the pressurized fuel in the accumulator 54 and a pressure of the pressurized fuel in the fuel rail 34. Each of these factors could affect how the accumulator 54 is able to supply the pressurized fuel to the fuel rail 34 via the opened accumulator valve 58, and thus could be accounted for in controlling the accumulator valve 58.

At 124, the controller 70 optionally determines whether the measured accumulator pressure is less than a threshold, such as a lower threshold of a desired pressure range for the accumulator 54. In one exemplary implementation, this lower threshold is slightly higher than the measured pressure or desired pressure of the fuel rail 34. If false, the method 100 then ends or returns to 104. If true, however, the method 100 proceeds to 128. At 128, the controller 70 optionally recharges the accumulator 54. In one exemplary implementation, recharging the accumulator 54 includes commanding the accumulator valve 58 closed and commanding the positive displacement fuel pump 30 to supply the pressurized fuel to the accumulator 54. The method 100 then ends or returns to 104.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A direct injection (DI) fuel supply system for an engine of a vehicle, the DI fuel supply system comprising:

a fuel rail in fluid communication with a high pressure fuel line and configured to house pressurized fuel;

a fuel injector configured to inject at least a portion of the pressurized fuel housed in the fuel rail into the engine;

a DI positive displacement fuel pump driven by a crankshaft of the engine, the DI positive displacement fuel pump in fluid communication with and configured to supply the pressurized fuel to the high pressure fuel line;

an accumulator fluidly coupled to the high pressure fuel line at a position between the fuel rail and the fuel pump, the accumulator configured to house the pressurized fuel;

an accumulator valve positioned in the high pressure fuel line at a location between the accumulator and the fuel rail, the accumulator valve configured to:

variably open to regulate the flow of the pressurized fuel from both the DI fuel pump and the accumulator to the fuel rail, and close to insulate the fuel rail and the fuel injector from both (i) high fuel pressure during recharging of the accumulator and (ii) fuel pressure pulsations generated by the DI fuel pump during recharging of the accumulator; and a controller configured to:

detect whether the accumulator is charged, estimate the portion of the pressurized fuel that the fuel injector will inject during a fuel injection event, when the accumulator is charged, disable the fuel pump and control opening of the accumulator valve proximate the fuel injection event such that the accumulator supplies the fuel rail with approximately the estimated portion of the pressurized fuel injected during the fuel injection event, and when the accumulator is not charged, close the accumulator valve and control the fuel pump to recharge the accumulator.

2. The DI fuel supply system of claim 1, further comprising a piezo device configured to generate cancellation fuel pressure pulsations in the DI fuel supply system, wherein the controller is configured to control the piezo device to generate the cancellation fuel pressure pulsations to cancel at least a portion of the fuel pressure pulsations generated by the DI positive displacement fuel pump.

3. The DI fuel supply system of claim 1, wherein the controller is configured to control the accumulator valve based further on at least one of:

(i) a static flow rate of the accumulator valve;

(ii) a timing of the fuel injection event;

(iii) a desired pressure of the pressurized fuel in the fuel rail; and (iv) a pressure differential between a pressure of the pressurized fuel in the accumulator and a pressure of the pressurized fuel in the fuel rail.

4. The DI fuel supply system of claim 3, further comprising a fuel rail pressure sensor configured to measure a pressure of the pressurized fuel in the fuel rail, wherein the controller is configured to utilize measurements from the fuel rail pressure sensor in detecting whether the accumulator is charged and in controlling the opening of the accumulator valve.

5. The DI fuel supply system of claim 3, further comprising an accumulator pressure sensor configured to measure a pressure of the pressurized fuel in the accumulator, wherein the controller is configured to utilize measurements from the accumulator pressure sensor in detecting whether the accumulator is charged and in controlling the opening of the accumulator valve.

6. The DI fuel supply system of claim 5, wherein the controller is further configured to control charging of the accumulator by the DI positive displacement fuel pump based on the measurements from the accumulator pressure sensor.

7. The DI fuel supply system of claim 6, wherein the controller is configured to enable charging of the accumulator by the DI fuel pump when the measured accumulator pressure is less than a low pressure threshold, and wherein the controller is configured to disable charging of the accumulator by the DI fuel pump when the measured accumulator pressure is greater than a high pressure threshold that is greater than the low pressure threshold.

8. A method of operating a direct injection (DI) fuel supply system of a vehicle, the DI fuel supply system having a high pressure fuel line fluidly coupled to a fuel rail in fluid communication with a fuel injector, the method comprising:

determining, at a controller of the DI fuel supply system, an estimated amount of a pressurized fuel from the fuel rail to be injected by the fuel injector during a fuel injection event, the DI fuel supply system including an accumulator valve in the high pressure fuel line positioned upstream of the fuel rail and downstream of an accumulator fluidly coupled to the high pressure fuel line, the accumulator valve being configured to close to insulate the fuel rail and the fuel injector from both (i) high fuel pressure during recharging of the accumulator and (ii) fuel pressure pulsations generated by the DI fuel pump during recharging of the accumulator;

detecting, by the controller, whether the accumulator is charged;

when the accumulator is charged:

disabling, by the controller, a DI positive displacement fuel pump of the DI fuel supply system, and controlling, by the controller, opening of the accumulator valve during the fuel injection event such that the accumulator supplies the fuel rail with approximately the estimated portion of the pressurized fuel injected during the fuel injection event; and when the accumulator is not charged, controlling, by the controller, recharging of the accumulator by:

commanding the accumulator valve closed; and commanding the fuel pump to supply the pressurized fuel to the accumulator.

9. The method of claim 8, further comprising controlling, by the controller, a piezo device of the DI fuel supply system to generate cancellation fuel pressure pulsations that cancel at least a portion of the fuel pressure pulsations generated by the DI positive displacement fuel pump.

10. The method of claim 8, wherein controlling the accumulator valve during the fuel injection event is further based on at least one of:

(i) a static flow rate of the accumulator valve;

(ii) a timing of the fuel injection event;

(iii) a desired pressure of the pressurized fuel in the fuel rail; and (iv) a pressure differential between a pressure of the pressurized fuel in the accumulator and a pressure of the pressurized fuel in the fuel rail.

11. The method of claim 10, further comprising receiving, at the controller from a fuel rail pressure sensor, measurements of the pressure of the pressurized fuel in the fuel rail, wherein detecting whether the accumulator is charged and controlling the opening of the accumulator valve are based further on the measurements from the fuel rail pressure sensor.

12. The method of claim 11, further comprising receiving, at the controller from an accumulator pressure sensor, measurements of the pressurized fuel in the accumulator, wherein detecting whether the accumulator is charged and controlling the opening of the accumulator valve are based further on the measurements from the accumulator pressure sensor.

13. The method of claim 12, further comprising controlling, by the controlling, charging of the accumulator by the DI positive displacement fuel pump based on the measurements from the accumulator pressure sensor.

14. The method of claim 13, wherein controlling charging of the accumulator by the DI fuel pump includes:

enabling, by the controller, charging of the accumulator by the DI positive displacement fuel pump when the measured accumulator pressure is less than a low pressure threshold; and disabling, by the controller, charging of the accumulator by the DI positive displacement fuel pump when the measured accumulator pressure is greater than a high pressure threshold that is greater than the low pressure threshold.

15. The DI fuel supply system of claim 1, wherein the controller is configured to control the accumulator valve based further on:

(i) a static flow rate of the accumulator valve;

(ii) a timing of the fuel injection event;

(iii) a desired pressure of the pressurized fuel in the fuel rail; and (iv) a pressure differential between a pressure of the pressurized fuel in the accumulator and a pressure of the pressurized fuel in the fuel rail.

16. The method of claim 8, wherein controlling the accumulator valve during the fuel injection event is further based on:

(i) a static flow rate of the accumulator valve;

(ii) a timing of the fuel injection event;

(iii) a desired pressure of the pressurized fuel in the fuel rail; and (iv) a pressure differential between a pressure of the pressurized fuel in the accumulator and a pressure of the pressurized fuel in the fuel rail.

* * * * *